United States Patent [19]

Proctor et al.

[11] Patent Number: 4,614,231

[45] Date of Patent: Sep. 30, 1986

[54] EVAPORATORS

[75] Inventors: Robert H. Proctor, Cockeysville; Arthur G. Hobbs, Jr., Hampstead, both of Md.; Charles S. Argyle, North York, Canada

[73] Assignee: Murray Corporation, Cockeysville, Md.

[21] Appl. No.: 774,867

[22] Filed: Sep. 11, 1985

Related U.S. Application Data

[63] Continuation of Ser. No. 626,485, Jul. 3, 1984, abandoned, which is a continuation of Ser. No. 406,260, Aug. 9, 1982, abandoned.

[51] Int. Cl.[4] ..... F28F 9/02

[52] U.S. Cl. ..... 165/153; 165/175; 165/178

[58] Field of Search ..... 165/77, 149, 153, 164, 165/165, 166, 178, 175; 285/233, 353, 384

[56] References Cited

U.S. PATENT DOCUMENTS

| | | | |
|---|---|---|---|
| 1,795,055 | 3/1931 | Taylor et al. | 165/153 X |
| 1,810,215 | 6/1931 | Karmazin | 165/175 X |
| 2,190,584 | 2/1940 | Feldmeier et al. | 165/77 |
| 2,211,514 | 8/1940 | Newhall | 165/77 |
| 2,257,442 | 9/1941 | Yula | 165/175 X |
| 2,599,389 | 6/1952 | Hume | 285/353 X |
| 2,858,112 | 10/1958 | Gerstung | 165/153 |
| 3,499,484 | 3/1970 | Lanzoni | 165/178 X |
| 3,850,234 | 11/1974 | Fowler | 165/153 |
| 3,976,128 | 8/1976 | Patel et al. | 165/153 |
| 4,011,905 | 3/1977 | Millard | 165/166 |
| 4,034,802 | 7/1977 | Schwarz | 165/175 X |
| 4,274,482 | 6/1981 | Sonoda | 165/153 |
| 4,327,802 | 5/1982 | Beldam | 165/153 |

*Primary Examiner*—Michael Koczo
*Attorney, Agent, or Firm*—Irvin A. Lavine

[57] ABSTRACT

An evaporator core assembly for automotive air-conditioning service is disclosed in which attaching tubes, comprising the inlet, outlet and to some cases, an oil return tube, are removably secured to the core assembly in such a manner that the tubes may be adjusted to any desired angle in relation to the core assembly thereby reducing the service parts storage volume, required for making evaporator core assemblies of different or unique designs, as well as enabling the core assemblies to be made of different stack heights or dimensions. The removability is accomplished through the use of fittings of unique design, and nuts which are used in combination with these fittings.

13 Claims, 2 Drawing Figures

EVAPORATORS

This application is a continuation of application Ser. No. 626,485, filed 7/3/84, abandoned, which is a continuation of Ser. No. 406,260, filed, 8/9/82, abandoned.

BACKGROUND OF THE INVENTION

This invention relates to evaporator cores for automotive air conditioners and the like.

The evaporator cores in General Motors and Ford automobiles are made by brazing preformed aluminum sheets together in a sophisticated brazing operation, in which considerable tooling cost is involved in each unit. The attaching tubes in the inlet, outlet, and in some cases, the oil return tube, are brazed and/or welded to the core.

This total assembly is generally unique to particular or specific applications and therefore poses an undesirable service parts inventory situation. The situation is compounded by the fact that the permanent attachments of the tubes makes the part bulky and therefore requires considerable service parts storage volume per unit.

SUMMARY OF THE INVENTION

The invention has, as its primary object, the provision of substantial improvements in the manufacture of service or replacement evaporators, for automotive air conditioners.

Another object of the invention is to provide an evaporator of the character described, which is of compact assembly and has unrestricted rotational positioning of the attaching tubes.

A further object of the invention is to provide an evaporator comprising a basic evaporator core, which uses a minimum number of components to arrive at many different stack heights and flow configurations, which can be assembled to a maximum number of pre-established physical and functional requirements.

We have devised a system where, using (in this case nine (9)) basic evaporator cores, we are enabled, through a unique manipulation of the attachments, to use common basic cores and removable inlet, outlet, and oil return tubes, to provide a concept wherein we are permitted to reduce the service parts storage volume and make the inventory more universal in its application.

The advantages of this system reside in reducing inventory storage volume and inventory by applying design techniques used to make the attaching tubes removable.

DESCRIPTION OF THE PREFERRED EMBODIMENT

Figure 1:
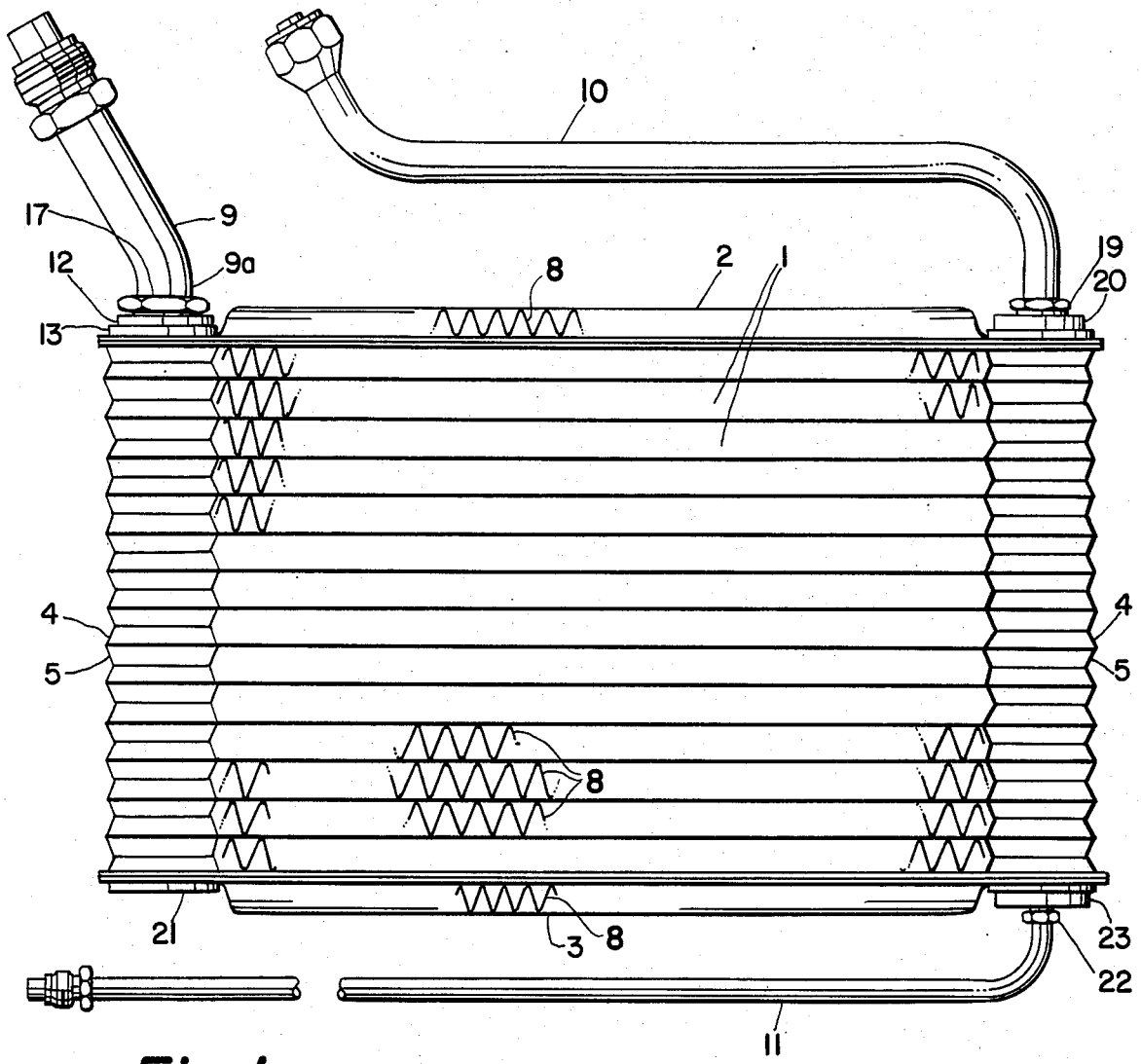
FIG. 1 is an elevational view partly schematic, showing a single pass evaporator assembly, embodying the invention.
Figure 2:
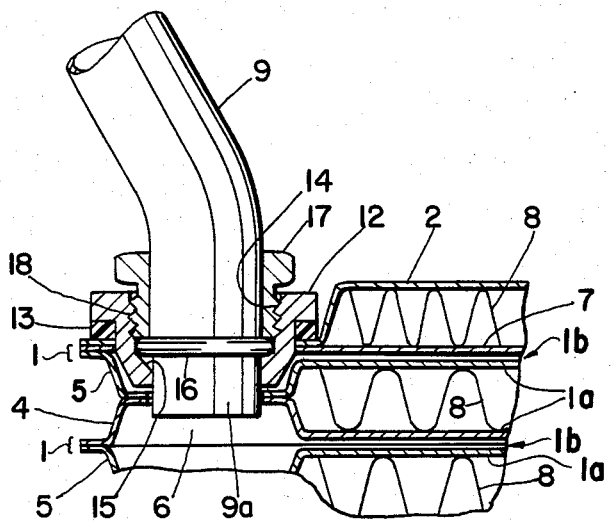
FIG. 2 is a fragmentary cross-sectional view, on an enlarged scale, of the upper left portion of FIG. 1.

Referring more particularly to FIGS. 1 and 2, there is shown in FIG. 1 an evaporator core assembly having features of conventional construction, including a plurality of stacked evaporator cores 1, each formed of a pair of dished aluminum sheets. Referring to FIG. 2, a typical core is shown comprising a pair of substantially identical core sheets 1*a* having a fluid passage 1*b* between them, the core sheets 1*a* being joined at their margins as is conventional. The core sheets 1*a* are dished at their ends, to provide the protruding dished portion 4 and the recessed dished portion 5, the sheets 1*a* being, as is conventional, preferably of the same shape, but reversely oriented as shown to provide an individual core. The dished portions 4, 5 are apertured, so as to provide a passageway 6 through the cores transversely of them, in the nature of a header, so that fluid will flow between headers at the ends of the cores through the fluid passage 1*b*. The sheets are brazed to each other at their margins to form the individual cores 1 and to provide a core assembly of stacked cores 1. In the space between individual cores 1, conventional sinusoidal heat conducting fins 8 are provided to conduct heat transferred from the fluid within the core assembly to air passing in the spaces between the cores 1.

A top terminal sheet 2 and a bottom terminal sheet 3 are provided to cover and hold the endmost fins 8. As shown in FIG. 2, the terminal sheet 2 is over the endmost core 1 and has a portion of it spaced from and generally parallel to the endmost sheet 7 of the endmost core 1, the spaced portion of terminal sheet 2 being in laterally spaced relationship to the dished portion 5 of the endmost dished core sheet 1*a*. The core sheet 7, which cooperates with the endmost dished core sheet 1*a* has an apertured flat portion overlying the apertured recessed portion of the endmost dished core sheet 1*a*, and it is to the upper surface of the cooperating core sheet 7 of the endmost core 1 that the terminal sheet 2 is attached.

The evaporator assembly further comprises an outlet tube 9, an inlet tube 10, and an oil return tube 11, which are normally brazed and/or welded to the core.

This normal procedure or assembly, as previously stated, is generally unique to specific applications and therefore poses an undesirable service parts inventory situation, which is compounded by the fact that the permanent attachment of the tubes makes the part bulky and therefore requires considerable service parts storage volume per unit.

In the present invention, a female joint fitting 12 is provided, having an axially extending portion which extends through a reinforcement plate 13 and is brazed to the latter. The fitting 12 also extends through the sheet 7, and into the passageway or channel 6 formed by the apertured dished portions 4 and 5 of the uppermost and next uppermost cores 1.

The fitting 12 is internally threaded, as at 14, and has a conical interior surface 15 below this threaded portion.

In the system, as illustrated in the drawings, common basic evaporator cores are employed, but instead of using outlet, inlet and oil return tubes which are brazed and/or welded to the core assembly, we provide outlet, inlet and oil return tubes, which are not only removably secured to the cores, but can be positioned rotationally at virtually any angle to the core, thereby permitting a large reduction in the number of service parts storage volume, making the inventory more universal in its application.

The outlet tube 9 has an angulated portion 9*a*, which extends into the passageway 6, and which is provided with an annular flange 16, which is seated on the conical surface 15 of the fitting 12. An "O" ring (not shown)

may be interposed between the flange 16, and the conical surface 15, to provide improved sealing.

The tube 9 is secured to the fitting 12 by means of a male swivel nut 17 having an hexagonal head and an externally threaded lower portion 18, which is threadedly and removably secured to the threads 14 of the fitting 12.

By manipulation of the nut 17, the flange 16 of the tube 9 is clamped against the "O" ring, to which reference has been made.

The tube 9 is thus removably secured to the evaporator core assembly, while, at the same time, the tube may be rotated about the axis of the passageway or channel 6, thus positioning the tube at any desired angle to the evaporator core assembly.

The tube 10 is similarly secured to the evaporator core assembly by means of a male swivel nut 19 and a fitting 20, which are similar, in all respects, to the nut 17 and fitting 12, so that the tube 10 is not only removably secured to the evaporator core assembly, but may be rotated about the axis of the passageway or channel 6 at the opposite end of the assembly core assembly.

The passageway or channel 6 at the end below tube 9 is closed at the end by means of a closure 21.

The tube 11 is secured to the evaporator core assembly by means of a male swivel nut 22 and a fitting 23, which are similar in all respects to the nut 17 and fitting 12, so that the tube 11 is not only removably secured to the evaporator core assembly, but may be rotated about the axis of the passageway or channel at the opposite end of the assembly, thus positioning the tube at any desired angle to the evaporator core assembly.

The features which have been described are adaptable for use with so-called "U" flow evaporators, which has a refrigerant flow pattern which goes into the top, across the bottom and back out through the top of the evaporator, as compared to conventional evaporators, in which the flow is into the bottom and out of the top.

A significant feature of the present invention resides in yhe dimensions of the assembly. The number of threads and specific details of the attaching nuts are such that the overall height from the top of the nut 17 to the end of the evaporator (sheet 2) is approximately equivalent to the normal bead of weld found on these assemblies. This is critical and necessary, because the space available in the molded evaporator housing precludes the use of anything having dimensions larger than these.

The evaporator assembly in the drawing is not shown in its normal use position. The normal position has the tubes 10 and 11 attached to the bottom and the single tube 9 attached to the top of the evaporator.

When the oil return tube 11 is not required, the plate 23 is plugged by means of a fitting, such as 22, except that it is not drilled to receive a tube.

It is to be understood that the form of our invention, herewith shown and described, is to be taken as a preferred example of the same and that various changes in the shape, size and arrangement of parts may be resorted to without departing from the spirit of our invention or the scope of the subjoined claims.

Having thus described my invention, I claim:

1. An evaporator core assembly comprising at least four dished, marginally joined sheets, said sheets each having adjacent a margin thereof means defining a passageway transversely of said core assembly and comprising an apertured dished portion, the dished portion of one endmost dished sheet of said evaporator core assembly being an apertured recessed dished portion, a female joint part of a separable joint having an axially extending portion positioned to extend into said recessed apertured dished portion of said dished endmost sheet, and means for securing said female joint part in said position.

2. The evaporator core assembly of claim 1 and further comprising a cooperating sheet having an apertured flat portion overlying said apertured recessed portion of said endmost dished sheet, and means for joining said cooperating sheet to said endmost dished sheet.

3. The evaporator core assembly of claim 2, wherein at least some of said dished sheets adjacent to each other are spaced apart interiorly of the margins thereof to provide a passage communicating with said passageway, and wherein said cooperating sheet and said endmost dished sheet have a passage between them communicating with said passageway.

4. The evaporator core assembly of claim 1, and fins extending between some of said sheets.

5. The evaporator core assembly of claim 1, said female joint part comprising an internally threaded fitting.

6. The evaporator core assembly of claim 5, and in combination therewith a male threaded fitting threadedly engaging said female threaded fitting, and a tube extending through said fittings and in fluid communication with said passageway.

7. A evaporator core assembly of claim 1, and in combination therewith a male joint part of a separable joint in mating relation with said female joint part, and a tube extending through said joint parts and in fluid communication with said passageway.

8. The evaporator core assembly of claim 1, and further comprising a terminal sheet, an aperture in said terminal sheet, means securing said terminal sheet to a sheet of the core assembly with the aperture thereof in alignment with said dished portion of said dished endmost sheet, said securing means securing said female joint part to said terminal sheet.

9. The evaporator core assembly of claim 1, said female joint part extending oppositely to the endmost dished sheet and only approximately as far as the extent of any other part of said core assembly.

10. The evaporator core assembly of claim 1, wherein at least some of said dished sheets adjacent to each other are spaced apart interiorly of the margins thereof to provide a passage communicating with said passageway.

11. An evaporator core assembly comprising:

a plurality of stacked cores, each said core comprising a pair of dished, marginally joined sheets, said sheets having complimentary dished portions adjacent a margin thereof, said dished portions being apertured, said cores assembled to provide through said apertures of said dished portions a passageway in said core assembly transversely of said sheets of said cores, an endmost dished sheet of said evaporator core assembly having the dished portion thereof recessed, a terminal sheet over a substantial portion of the said endmost sheet and having a portion thereof spaced from and generally parallel to the said endmost sheet, said portion of said terminal sheet being in laterally spaced relationship to said dished portion of said endmost dished sheet, an internally threaded tube joint fitting having a portion extending into said recessed dished portion of said endmost dished sheet, brazing means securing said fitting to said terminal sheet, said fitting extending outwardly of said seat to an extent not beyond the said portion of said terminal sheet.

12. The evaporator core assembly of claim 11, each of said cores having a passage therein communicating with said passageway.

13. The evaporator core assembly of claim 12, and further comprising an endmost sheet between said terminal sheet and said endmost dished sheet, and a passage between said endmost sheet and said endmost dished sheet communicating with said passageway.

* * * * *